US007576724B2

(12) United States Patent
Lin et al.

(10) Patent No.: US 7,576,724 B2
(45) Date of Patent: Aug. 18, 2009

(54) LIQUID CRYSTAL DISPLAY DEVICE AND ELECTRONIC DEVICE

(75) Inventors: Ching-Yao Lin, Hemei Township (TW); Chung-Wen Lai, Yingge Township (TW); Norio Oku, Taipei (TW); Li-Sen Chuang, Penghu (TW)

(73) Assignee: TPO Displays Corp., Chu-Nan (TW)

( * ) Notice: Subject to any disclaimer, the term of this patent is extended or adjusted under 35 U.S.C. 154(b) by 739 days.

(21) Appl. No.: 11/200,537

(22) Filed: Aug. 8, 2005

(65) Prior Publication Data

US 2007/0030238 A1 Feb. 8, 2007

(51) Int. Cl.
*G09G 3/36* (2006.01)

(52) U.S. Cl. ..... 345/98; 345/100; 345/690

(58) Field of Classification Search ..... 345/76, 345/100, 74.1, 58, 42, 54, 55, 63, 9, 209, 345/212, 690, 694
See application file for complete search history.

(56) References Cited

U.S. PATENT DOCUMENTS

2001/0050665 A1* 12/2001 Yeo et al. ..... 345/87
2002/0070909 A1* 6/2002 Asano et al. ..... 345/76
2002/0135828 A1 9/2002 Shirochi et al.
2002/0180718 A1 12/2002 La
2003/0085859 A1 5/2003 Lee
2003/0197815 A1* 10/2003 Choi et al. ..... 349/43
2004/0174448 A1 9/2004 Azami
2005/0104818 A1* 5/2005 Kwak et al. ..... 345/76

FOREIGN PATENT DOCUMENTS

EP 1069457 1/2001
JP 11-338438 12/1999

* cited by examiner

*Primary Examiner*—Amr Awad
*Assistant Examiner*—Tony Davis
(74) *Attorney, Agent, or Firm*—Liu & Liu

(57) ABSTRACT

A liquid crystal display device and an electronic device, which provide compensation for the difference of brightness caused by the LC effect to improve the image color fidelity is provided. The present invention provides a source driving method for a LCD device including providing data signals representing images to be displayed at a plurality of sub-pixels corresponding to different display wavelengths within a pixel and sequentially activating the sub-pixels within the pixel, in the order from a sub-pixel corresponding to the shortest display wavelength to a sub-pixel corresponding to longest display wavelength.

9 Claims, 8 Drawing Sheets

LIQUID CRYSTAL DISPLAY DEVICE AND ELECTRONIC DEVICE

BACKGROUND OF THE INVENTION

1. Field of the Invention

The present invention relates to a display device. More particularly, the present invention relates to a liquid crystal display (LCD) device.

2. Description of Related Art

Recently, LCD device has gradually become the mainstream of display device because of their advantageous features of light weight, compact size, suitable for large or small area application, low operation voltage, low power consumption, and low radiation. Especially, LCD device is more applicable for portable electronic device such as the screen of notebook, mobile phone, or personal digital assistance (PDA). Therefore, the LCD device has become an indispensable device and its development is very important.

FIG. 1 is a schematic view of a conventional LCD panel system. As shown in FIG. 1, a conventional LCD panel system 100 generally comprises a LCD panel 102, a gate driver 104 and a source driver 106. The LCD panel 102 comprises a pixel array constructed by a plurality of pixels. For example, in a conventional LCD panel having resolution of 1024×768, the pixels are arranged in a matrix with 1024 columns and 768 rows, wherein each pixel comprises three sub-pixels having red, green and blue colors respectively. Therefore, the sub-pixels are arranged in a matrix with 3072 columns and 768 rows in the foregoing liquid crystal panel. As shown in FIG. 1, each pixel 112 in the first column of the LCD panel 102 comprises three sub-pixels, i.e., a red sub-pixel 112*r*, a green sub-pixel 112*g*, and a blue sub-pixel 112*b*. In addition, the first row also comprises other pixels such as pixel 114 and so on. Each sub-pixel comprises a thin film transistor (TFT) and a storage capacitor, wherein the storage capacitor is formed by a pixel electrode (not shown) connected to the drain of the TFT, a common electrode and a dielectric layer disposed therebetween. The gate of the TFT is controlled by the gate driver 104 via a corresponding scan line SL1, SL2 . . . or SLm. For example, the gates of the thin film transistors of the sub-pixels 112*r*, 112*g* and 112*b* is controlled by the scan line SL1. The source of the TFT is controlled by the source driver 106 via a corresponding data line DL1, DL2 . . . or DLn. For example, the sources of the thin film transistors of the sub-pixels 112*r* and 122*r* are controlled by the data line DL1.

The gate driver 104 receives a basic clock and a start pulse. After the start pulse is received by the gate driver 104, a plurality of scan signals are generated by the gate driver 104 according to the basic clock and output to the scan lines SL1, SL2 . . . and SLm sequentially.

The source driver 106 receives a digital input data in serial, and then the digital input data is converted into an analog data and output to data lines DL1, DL2 . . . and DLn in parallel simultaneously. Therefore, when the gate driver 104 receives the start pulse and output a scan signal to a specific scan line (e.g., scan line SL1) to turn on the gates of the thin film transistors of the pixels (e.g., the sub-pixels 112*r*, 112*g*, 112*b* etc.), the analog data is input to the sources of the thin film transistors of the sub-pixels 112*r*, 112*g*, 112*b* via the data lines DL1, DL2, . . . and DLn, and then the analog data is stored in the capacitor via the drain of the TFT.

After the source driver 106 receiving the digital input data, the digital input data is converted into the analog data via a digital to analog converter (DAC), wherein an applicable voltage is selected from a set of reference voltage and provided as the analog data according to the digital input data.

For example, if the brightness of the digital input signal of the sub-pixel of the liquid crystal panel 102 as shown in FIG. 1 has 6 bits gray scale level, the set of reference voltage has $2^6=64$ reference voltages. Thus, the brightness of the sub-pixel is dependent on the reference voltage stored in the storage capacitor thereof. In general, the relationship between the brightness $B_R$, $B_G$ and $B_B$ of the three primary colors (red, green and blue) of the sub-pixels (e.g., sub-pixels 112*r*, 112*g*, 112*b* respectively) and the corresponding gray scale levels $G_R$, $G_G$ and $G_B$ may be represent by the following equations (1-1) to (1-3):

$$B_R=G_R^{\gamma} \tag{1-1}$$

$$B_G=G_G^{\gamma} \tag{1-2}$$

$$B_B=G_B^{\gamma} \tag{1-3}$$

γ represent gamma value parameter, conventionally, γ=2.2.

FIG. 2 illustrates relationships between the transmittance of the sub-pixels and the corresponding gray scale levels respectively corresponding to different color sub-pixels in a conventional LCD panel, wherein each sub-pixel includes a color filter to achieve the colorful displaying effect. It is noted that the property of liquid crystal (so called LC effect) may lead to variations among the transmittance of different color sub-pixels. Referring to FIG. 2, curve B1 represents the relationship between the transmittance and the corresponding gray scale level of the red sub-pixel (e.g., sub-pixel 112*r*); curve B2 represents the relationship between the transmittance and the corresponding gray scale level of the green sub-pixel (e.g., sub-pixel 112*g*); and curve B3 represents the relationship between the transmittance and the corresponding gray scale level of the blue sub-pixel (e.g., sub-pixel 112*b*). Specifically, corresponding to the same gray scale level, the transmittance of the blue sub-pixel is greater than that of the green sub-pixel, and the transmittance of the green sub-pixel is greater than that of the red sub-pixel due to the LC effect.

Besides, in order to reduce the pin count of the source driver 106, multiplexers are generally used to input the analog data to the data lines DL1, DL2, and DLn sequentially. FIG. 3 is a schematic circuit block diagram of one of the multiplexers. Referring to FIG. 3, the analog data AD from the digital to analog converter is input to the multiplexer 130. Then, switches SW1, SW2, and SW3 of the multiplexer 130 are turned on sequentially such that the analog data AD is input to the data lines DL1, DL2, and DL3 sequentially along a scan direction D. Since the analog data AD is input sequentially along the scan direction D, a coupling effect of voltage will generated when the sub-pixels 112*r*, 112*g*, 112*b* are driven via the data lines DL1, DL2, and DL3. In general, the coupling voltage ΔV between the data lines and the sub-pixels can be represented by the following equation (2):

$$\Delta V=(Cpd/\mathrm{Ctotal})*Vx \tag{2}$$

Cpd represents the parasitic capacitance between a sub-pixel and the nearby data line, Ctotal represents the total capacitance, and Vx represents the applied voltage from the data lines. Accordingly, the actual voltage stored in the sub-pixels (e.g., sub-pixels 112*r*, 112*g*, 112*b*) in three primary colors (red, green and blue) can be respectively represented by the following equations (3-1) to (3-3):

$$Vr=Vx+(2\Delta V) \tag{3-1}$$

$$Vg=Vx+(\Delta V) \tag{3-2}$$

$$Vb=Vx \tag{3-3}$$

In accordance with the equations (3-1) to (3-3), FIG. 4 is a plot of transmittance versus gray scale level of red, green, and blue sub-pixels with the coupling effect of voltage in a conventional LCD panel. Referring to FIG. 4, curve C1 represents the relationship between the transmittance and the gray scale of the red sub-pixel (e.g., sub-pixel 112*r*) with the coupling effect; curve C2 represents the relationship between the transmittance and the gray scale of the green sub-pixel (e.g., sub-pixel 112*g*) with the coupling effect; and curve C3 represents the relationship between the transmittance and the gray scale of the blue sub-pixel (e.g., sub-pixel 112*b*) with the coupling effect. It is noted that the coupling effect of voltage causes difference between the curves C1, C2, and C3, wherein the transmittance of the blue sub-pixel is greater than that of the green sub-pixel, and the transmittance of the green sub-pixel is greater than that of the red sub-pixel corresponding to the same gray scale level.

FIG. 5 is a plot of integration of the curves in FIG. 2 and FIG. 4 for illustrating actual transmittance versus gray scale level of red, green, and blue sub-pixels in a conventional LCD panel. Referring to FIG. 5, curve E1 represents the actual relationship between the transmittance and the gray scale of the red sub-pixel (e.g., sub-pixel 112*r*); curve E2 represents the actual relationship between the transmittance and the gray scale of the green sub-pixel (e.g., sub-pixel 112*g*); and curve E3 represents the actual relationship between the transmittance and the gray scale of the blue sub-pixel (e.g., sub-pixel 112*b*). Due to the integration of the LC effect and the coupling effect of voltage, the differences of transmittance between different color sub-pixels become more obvious. For example, the color of image tends to be blue, and the differences of transmittance affect the color fidelity of image.

SUMMARY OF THE INVENTION

Accordingly, the present invention is directed to a liquid crystal display device and an electronic device, which provide compensation for the difference of brightness caused by the LC effect to improve the image color fidelity. The present invention provides a source driving method for a LCD device comprising providing data signals representing images to be displayed at a plurality of sub-pixels corresponding to different display wavelengths within a pixel and sequentially activating the sub-pixels within the pixel, in the order from a sub-pixel corresponding to the shortest display wavelength to a sub-pixel corresponding to longest display wavelength.

In the aforementioned source driving method, the sub-pixels comprise first color sub-pixels each with a first displaying wavelength, second color sub-pixels each with a second displaying wavelength less than the first displaying wavelength, and third color sub-pixels each with a third displaying wavelength less than the second displaying wavelength. The step of providing the data signals comprises receiving a digital data and converting the digital data into an analog data, and the step of sequentially activating the sub-pixels within the pixel comprises sequentially outputting the analog data to the third color sub-pixel, the second color sub-pixel, and then the first color sub-pixel of the selected pixel.

The present invention provides a source driver for a LCD device. The source driver comprises an input of data signals representing images to be displayed at a plurality of sub-pixels corresponding to different display wavelengths within a pixel and an output module sequentially activating the sub-pixels within the pixel, in the order from a sub-pixel corresponding to the shortest display wavelength to a sub-pixel corresponding to longest display wavelength.

The present invention provides a LCD device, which comprises a LCD panel comprising a plurality of pixels, the source driver mentioned above, and a controller controlling the operations of the source driver.

The present invention provides an electronic device, which comprises a LCD device mentioned above and an input device providing image data to the controller in the LCD to render an image in accordance with the image data.

The present invention provides a control system for controlling the operation of a LCD device having a plurality of pixels that each comprises a plurality of sub-pixels corresponding to different display wavelengths within a pixel. The control system comprises the source driver mentioned above and a controller controlling the operations of the source driver.

The present invention provides a LCD device, which comprises a LCD panel comprising a plurality of pixels and the control system mentioned above.

The present invention provides an electronic device, which comprises a LCD device mentioned above and an input device providing image data to the controller in the LCD to render an image in accordance with the image data.

The present invention provide a source driving circuit for a liquid crystal display panel having a plurality of pixels each comprising a plurality of sub-pixels, comprising a plurality of data lines each coupled to a sub-pixel, a source driver controlling the sub-pixels via the data lines, wherein the source driver sequentially activates the sub-pixels within the pixel, in the order from a sub-pixel corresponding to the shortest display wavelength to a sub-pixel corresponding to longest display wavelength and a plurality of charge coupling components, each coupling two adjacent data lines.

The present invention is directed to a liquid crystal display panel system comprising a liquid crystal display panel comprising a plurality of scan lines, a plurality of data lines and a plurality of pixels, wherein each pixel comprises a plurality of sub-pixels; a gate driver electrically connected to the scan lines; and a source driving circuit electrically connected to the data lines.

The present invention is directed to an electronic device comprising a liquid crystal display system mentioned above and an input device providing image data to the liquid crystal display system to render an image in accordance with the image data.

Since the first color sub-pixel, the second color sub-pixel, and then the third color sub-pixel of the selected pixel are driven sequentially along a direction from the sub-pixel with smaller displaying wavelength to that with greater displaying wavelength, the coupling effect of voltage produced as driving the sub-pixels can be used to compensate for the difference of brightness caused by the LC effect. In addition, the charge coupling components electrically connected between every two adjacent data lines can further enhance the effect of compensation. Therefore, the image color fidelity can be improved.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
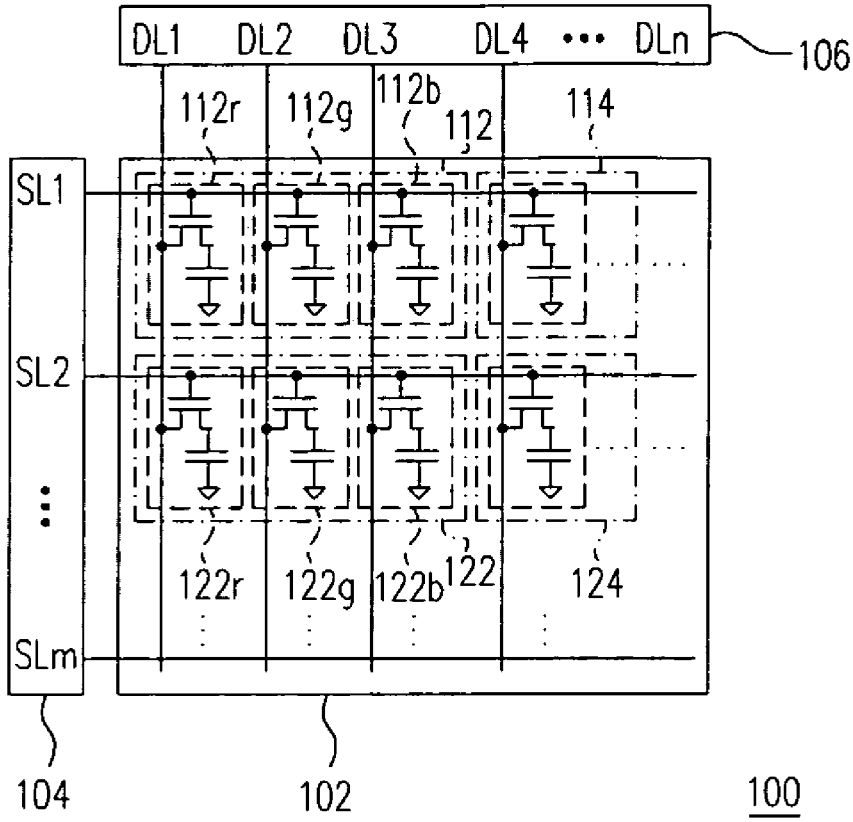
FIG. 1 (PRIOR ART)
FIG. 1 is a schematic view of a conventional LCD panel system.
Figure 2:
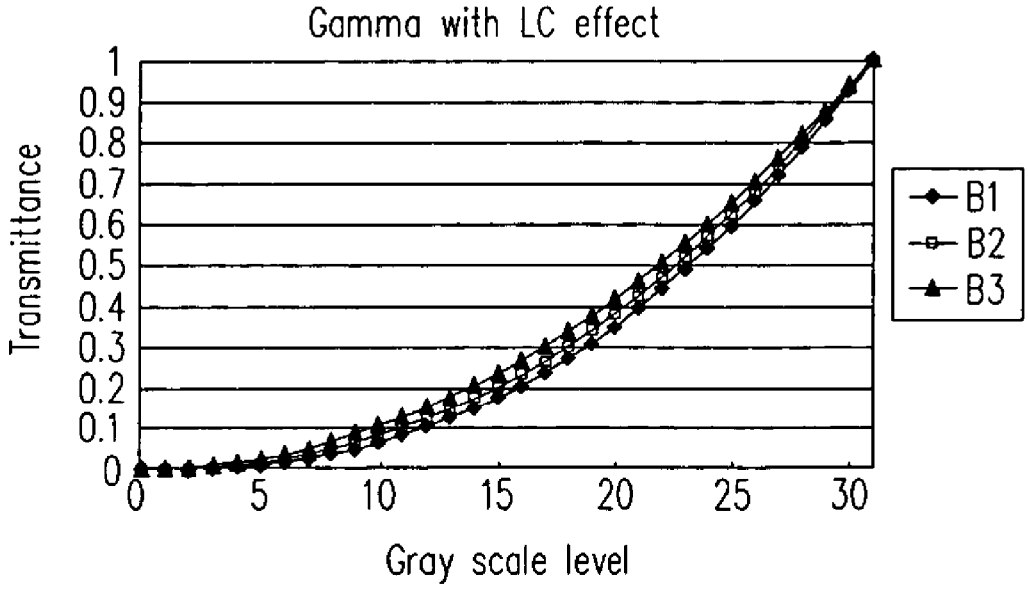
FIG. 2 (PRIOR ART)
FIG. 2 illustrates relationships between the transmittance of the sub-pixels and the corresponding gray scale levels respectively corresponding to different color sub-pixels in a conventional LCD panel.
Figure 3:
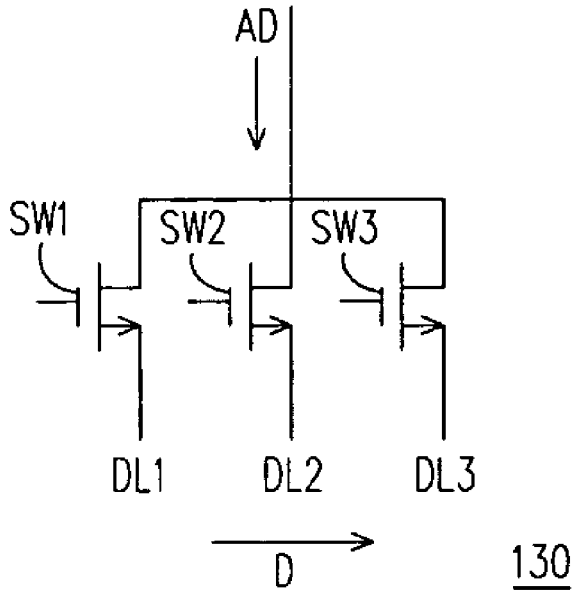
FIG. 3 (PRIOR ART)
FIG. 3 is a schematic circuit block diagram of a conventional multiplexer.
Figure 4:
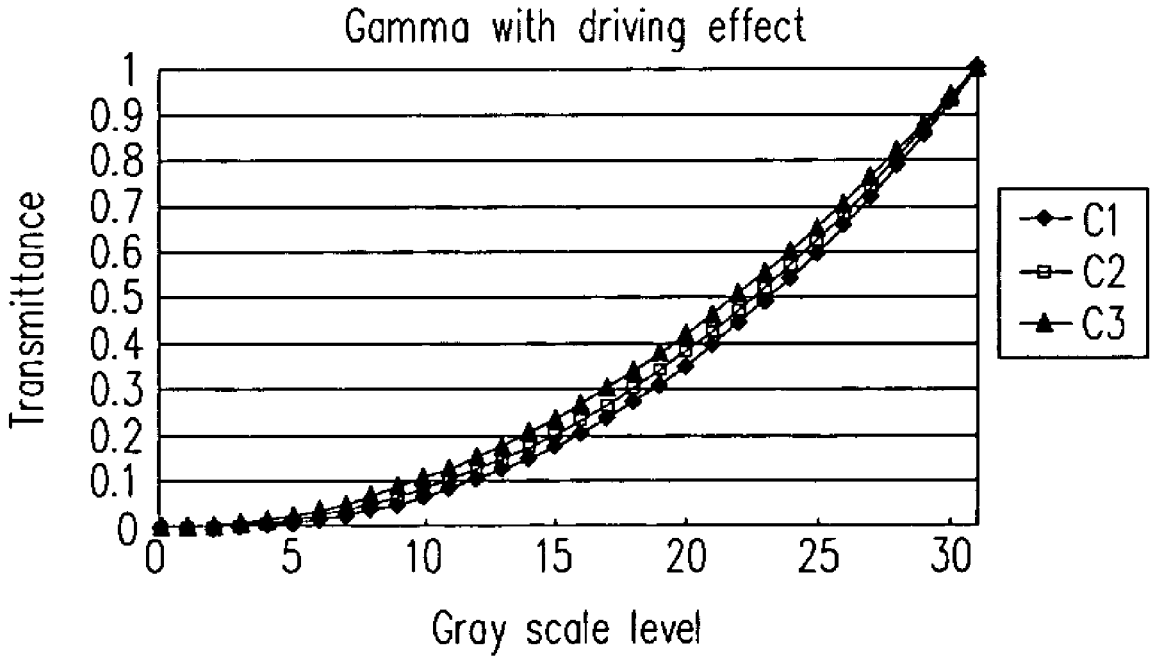
FIG. 4 (PRIOR ART)
FIG. 4 is a plot of transmittance versus gray scale level of red, green, and blue sub-pixels with the coupling effect of voltage in a conventional LCD panel.
Figure 5:
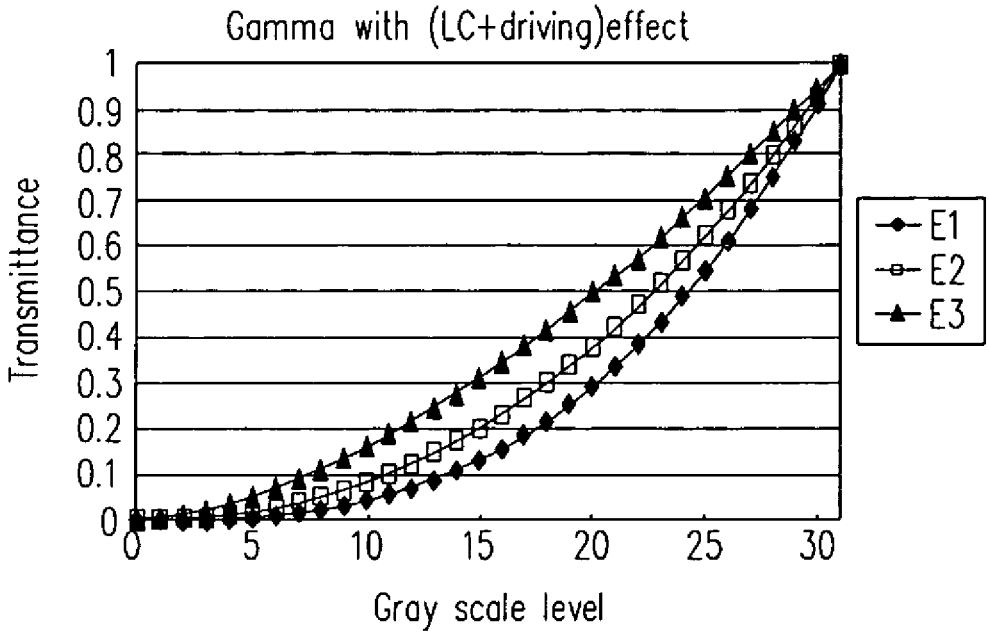
FIG. 5 (PRIOR ART)
FIG. 5 is a plot of integration of the curves in FIG. 2 and FIG. 4 for illustrating actual transmittance versus gray scale level of red, green, and blue sub-pixels in a conventional LCD panel.

Reference will now be made in detail to the present preferred embodiments of the invention, examples of which are illustrated in the accompanying drawings. Wherever possible, the same reference numbers are used in the drawings and the description to refer to the same or like parts.

Figure 6:
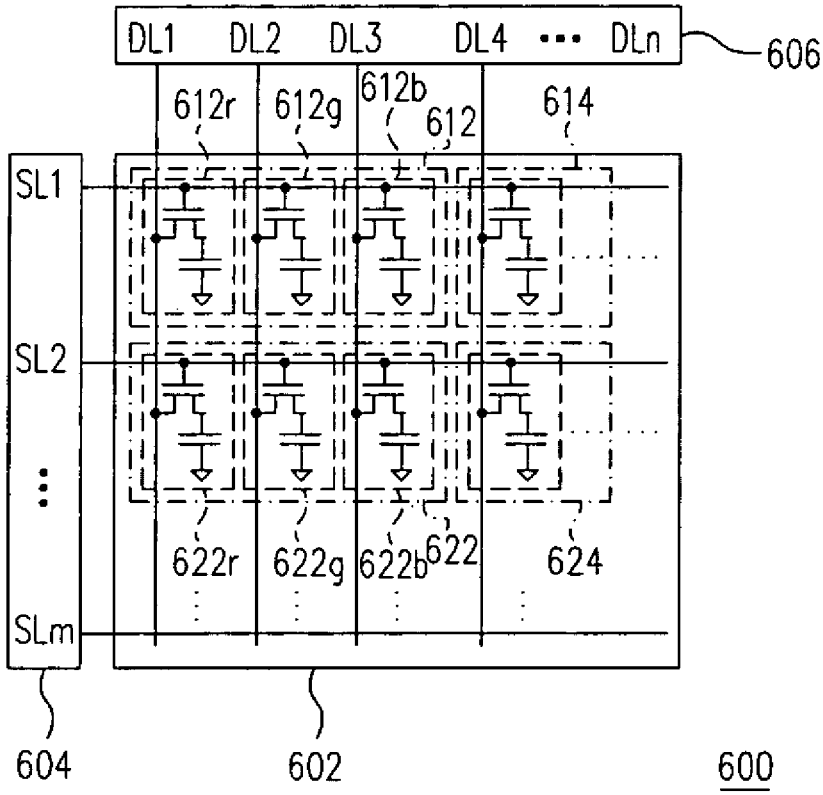
FIG. 6 is a schematic view of a LCD panel system according to one embodiment of the present invention.

FIG. 6 is a schematic view of a LCD panel system according to one embodiment of the present invention. As shown in FIG. 6, a LCD panel system 600 generally comprises a LCD panel 602, a gate driver 604 and a source driver 606. The LCD panel 602 comprises a pixel array constructed by a plurality of pixels. Each pixel, i.e., a pixel 612 in the first column of the LCD panel 602, has three different color sub-pixels, i.e., a red sub-pixel 612*r*, a green sub-pixel 612*g*, and a blue sub-pixel 612*b*. In addition, the first row also comprises other pixels such as pixel 614 and so on. Each sub-pixel has a thin film transistor (TFT) and a capacitor, wherein the capacitor is connected between the drain of the TFT and the common electrode. The gates of the TFTs are controlled by the gate driver 604 via corresponding scan lines SL1, SL2 . . . and SLm. For example, the gates of the thin film transistors of the sub-pixels 612*r*, 612*g* and 612*b* is controlled by the scan line SL1. The sources of the TFTs are controlled by the source driver 606 via corresponding data lines DL1, DL2 . . . and DLn. For example, the sources of the thin film transistors of the sub-pixels 612*r* and 622*r* are controlled by the data line DL1.

Figure 7:
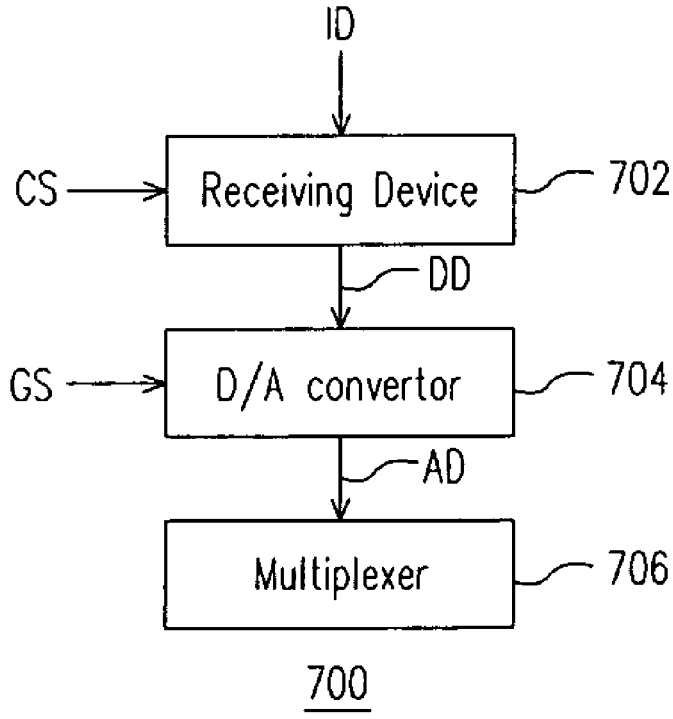
FIG. 7 is a schematic circuit block diagram of a source driver of a LCD panel according to one embodiment of the present invention.

FIG. 7 is a schematic circuit block diagram of a source driver of a LCD panel according to one embodiment of the present invention. As shown in FIG. 7, a source driver 700 may comprise, for example, a receiving module such as a receiving device 702, a converting module such as a digital to analog converter 704, and an output module such as a multiplexer 706. (The source driver 606 in FIG. 6 may comprise a similar structure as the source driver 700.) The receiving device 702 may be adopted for receiving and registering an input digital data ID (e.g., an input digital data input in serial), and outputting a plurality of digital data in parallel. In one embodiment of the present invention, receiving device 702 may comprise a latch, which may be adopted for receiving and registering the input digital data, and then outputting the digital data DD in parallel under the control of a clock signal CS.

Referring to FIG. 7, the digital to analog converter 704 receives the digital data DD and converts the digital data DD into an analog data AD. The digital data DD is converted into the analog data AD according to a gamma voltage signal GS, and an applicable voltage is selected from a set of reference voltage and provided as the analog data according to the gray scale level of the digital data DD. In addition, the multiplexer 706 is adopted for sampling the analog data AD, and then sequentially outputting the analog data AD to sub-pixels of a selected pixel.

Figure 8:
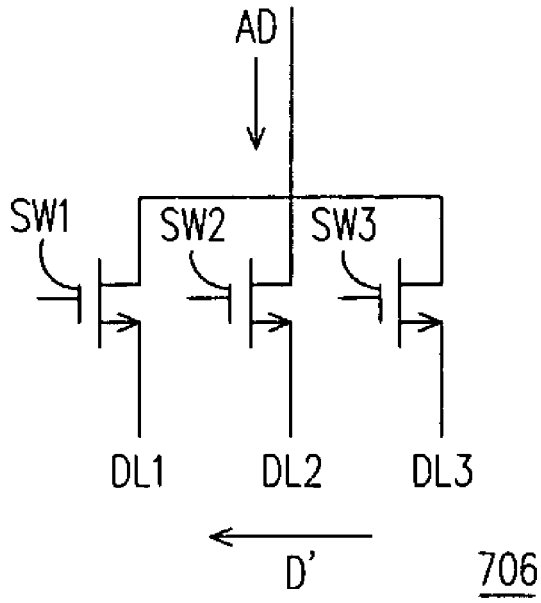
FIG. 8 is a schematic circuit block diagram of the multiplexer 706 according to one embodiment of the present invention.

FIG. 8 is a schematic circuit block diagram of the multiplexer 706 according to one embodiment of the present invention. As shown in FIG. 8, the multiplexer 706 comprises switches SW1, SW2, and SW3, which connected to different color sub-pixels of a pixel respectively via the data lines DL1, DL2, and DL3. The switch SW1 connected to the color sub-pixels with a first displaying wavelength (e.g., the red sub-pixel 612*r*), the switch SW2 connected to the color sub-pixels with a second displaying wavelength (e.g., the green sub-pixel 612*g*), and the switch SW3 connected to the color sub-pixels with a third displaying wavelength (e.g., the blue sub-pixel 612*b*). The second wavelength is less than the first wavelength, and the third wavelength is less than the second wavelength.

Referring to FIG. 8, the analog data AD from the digital to analog converter 704 is input to the multiplexer 706. In a period of time, a gate driver receives a start pulse and output a scan signal to a specific scan line (e.g., the scan line SL1) to turn on the gates of the thin film transistors of the sub-pixels (e.g., the sub-pixels 612*r*, 612*g* and 612*b*). Then, the switches SW3, SW2, and SW1 of the multiplexer 706 are turned on sequentially to input the analog data AD to the data lines DL3, DL2, and DL1 along a scan direction D'. It should be noted that the sub-pixel with the third displaying wavelength (e.g., the blue sub-pixel 612*b*) is driven first, then the one with the second displaying wavelength (e.g., the green sub-pixel 612*g*), and finally the one with the first displaying wavelength (e.g., the red sub-pixel 612*r*).

Since the analog data AD is input along the scan direction D', a coupling effect of voltage will produced as driving the sub-pixels 612*r*, 612*g*, 612*b* via the data lines DL1, DL2, and DL3. The actual voltage stored in the sub-pixels (e.g., sub-pixels 612*r*, 612*g*, 612*b*) in three primary colors (e.g., red, green and blue) can be respectively represented by the following equations (4-1) to (4-3):

$$Vr=Vx \tag{4-1}$$

$$Vg=Vx+(\Delta V) \tag{4-2}$$

$$Vb=Vx+(2\Delta V) \tag{4-3}$$

ΔV represents the coupling voltage between the data lines and the sub-pixels and Vx represents the applied voltage from the data lines.

Figure 9:
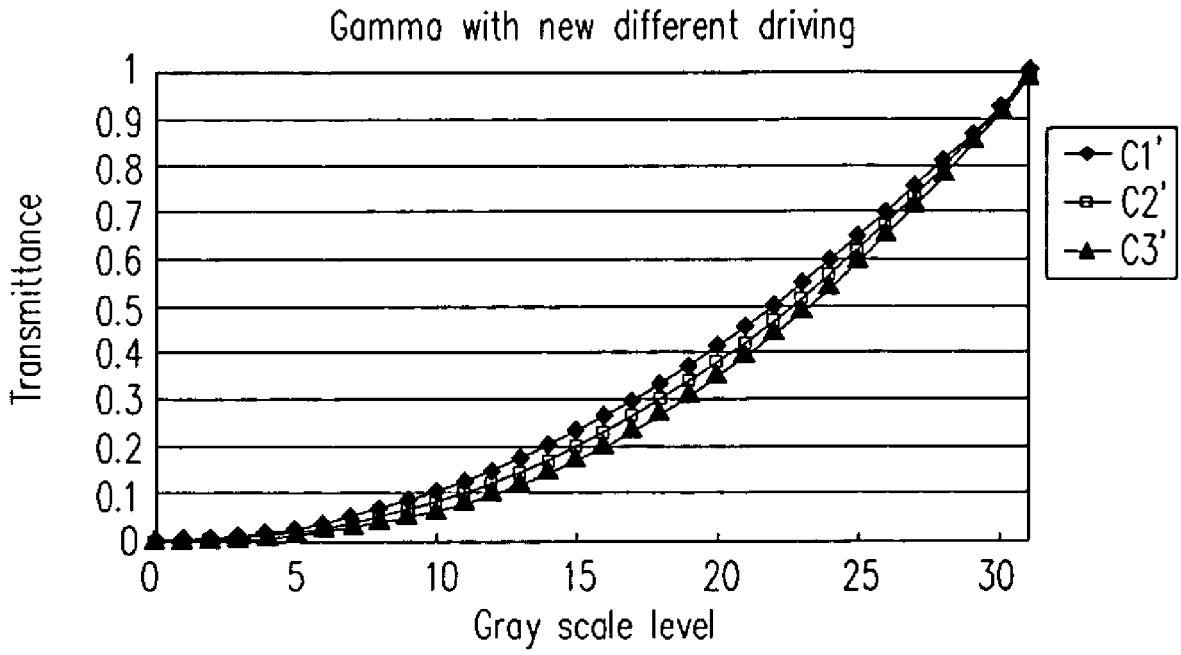
FIG. 9 is a plot of transmittance versus gray scale level of red, green, and blue sub-pixels with the coupling effect of voltage in a LCD panel according to one embodiment of the present invention.

FIG. 9 is a plot of transmittance versus gray scale level of red, green, and blue sub-pixels with the coupling effect of voltage in a LCD panel according to one embodiment of the present invention. Referring to FIG. 9, curve C1' represents the relationship between the transmittance and the gray scale of the red sub-pixel (e.g., sub-pixel 612*r*) with the coupling effect; curve C2' represents the relationship between the transmittance and the gray scale of the green sub-pixel (e.g., sub-pixel 612*g*) with the coupling effect; and curve C3' represents the relationship between the transmittance and the gray scale of the blue sub-pixel (e.g., sub-pixel 612*b*) with the coupling effect. Different from the conventional art, the transmittance of the red sub-pixel is greater than that of the green sub-pixel, and the transmittance of the green sub-pixel is greater than that of the blue sub-pixel corresponding to the same gray scale level.

Figure 10:
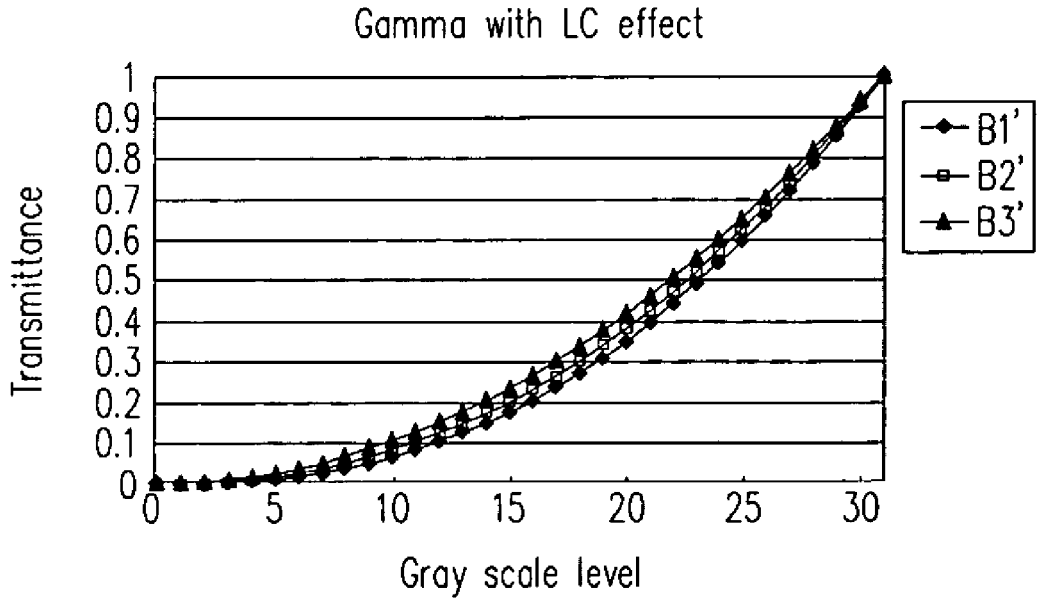
FIG. 10 illustrates relationships between the transmittance of the sub-pixels and the corresponding gray scale levels respectively corresponding to different color sub-pixels with the LC effect of voltage in a LCD panel according to one embodiment of the present invention.

FIG. 10 illustrates relationships between the transmittance of the sub-pixels and the corresponding gray scale levels respectively corresponding to different color sub-pixels with the LC effect of voltage in a LCD panel according to one embodiment of the present invention. Referring to FIG. 10, curve B1' represents the relationship between the transmittance and the corresponding gray scale level of the red sub-pixel (e.g., sub-pixel 612*r*); curve B2' represents the relationship between the transmittance and the corresponding gray scale level of the green sub-pixel (e.g., sub-pixel 612*g*); and curve B3' represents the relationship between the transmittance and the corresponding gray scale level of the blue sub-pixel (e.g., sub-pixel 612*b*). Due to the LC effect level, the transmittance of the blue sub-pixel is greater than that of the green sub-pixel, and the transmittance of the green sub-pixel is greater than that of the red sub-pixel corresponding to the same gray scale.

Figure 11:
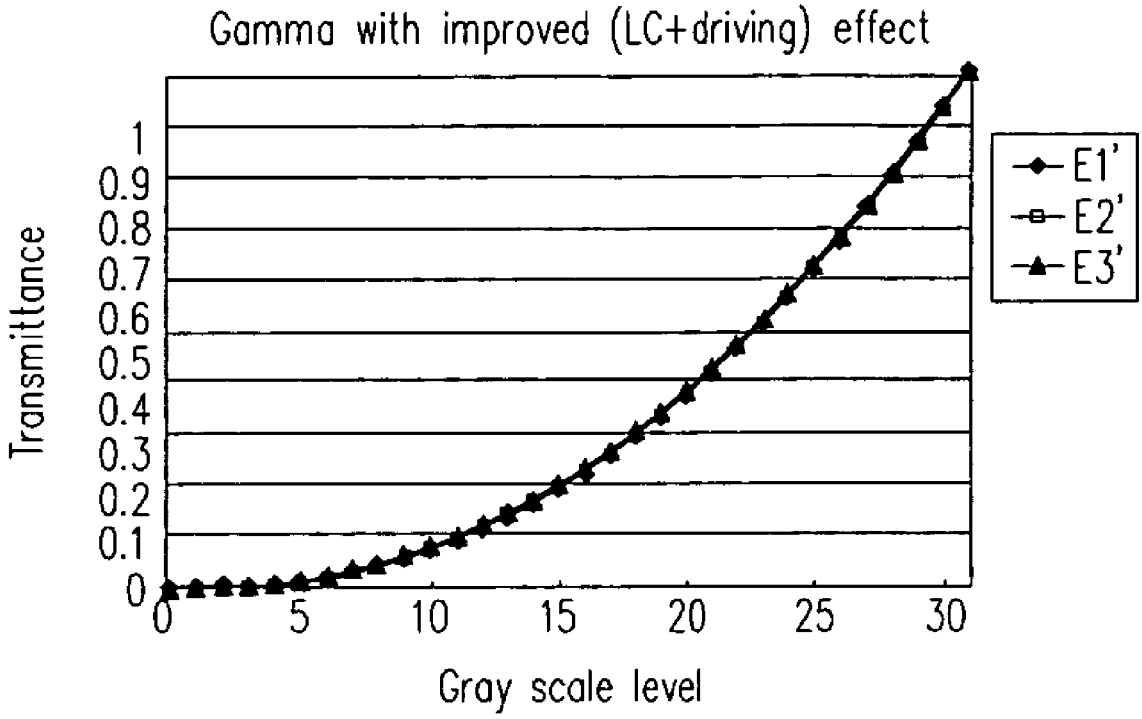
FIG. 11 is a plot of integration of the curves in FIG. 9 and FIG. 10 for illustrating actual transmittance versus gray scale level of red, green, and blue sub-pixels according to the present invention.

FIG. 11 is a plot of integration of the curves in FIG. 9 and FIG. 10 for illustrating actual transmittance versus gray scale level of red, green, and blue sub-pixels according to the present invention. Referring to FIG. 11, curve E1' represents the actual relationship between the transmittance and the gray scale of the red sub-pixel (e.g., sub-pixel 612*r*); curve E2' represents the actual relationship between the transmittance and the gray scale of the green sub-pixel (e.g., sub-pixel 612*g*); and curve E3' represents the actual relationship between the transmittance and the gray scale of the blue sub-pixel (e.g., sub-pixel 612*b*). Obviously, the difference of transmittance caused by the LC effect is decrease by the coupling effect of voltage caused by the source driving method of the present invention.

Figure 12:
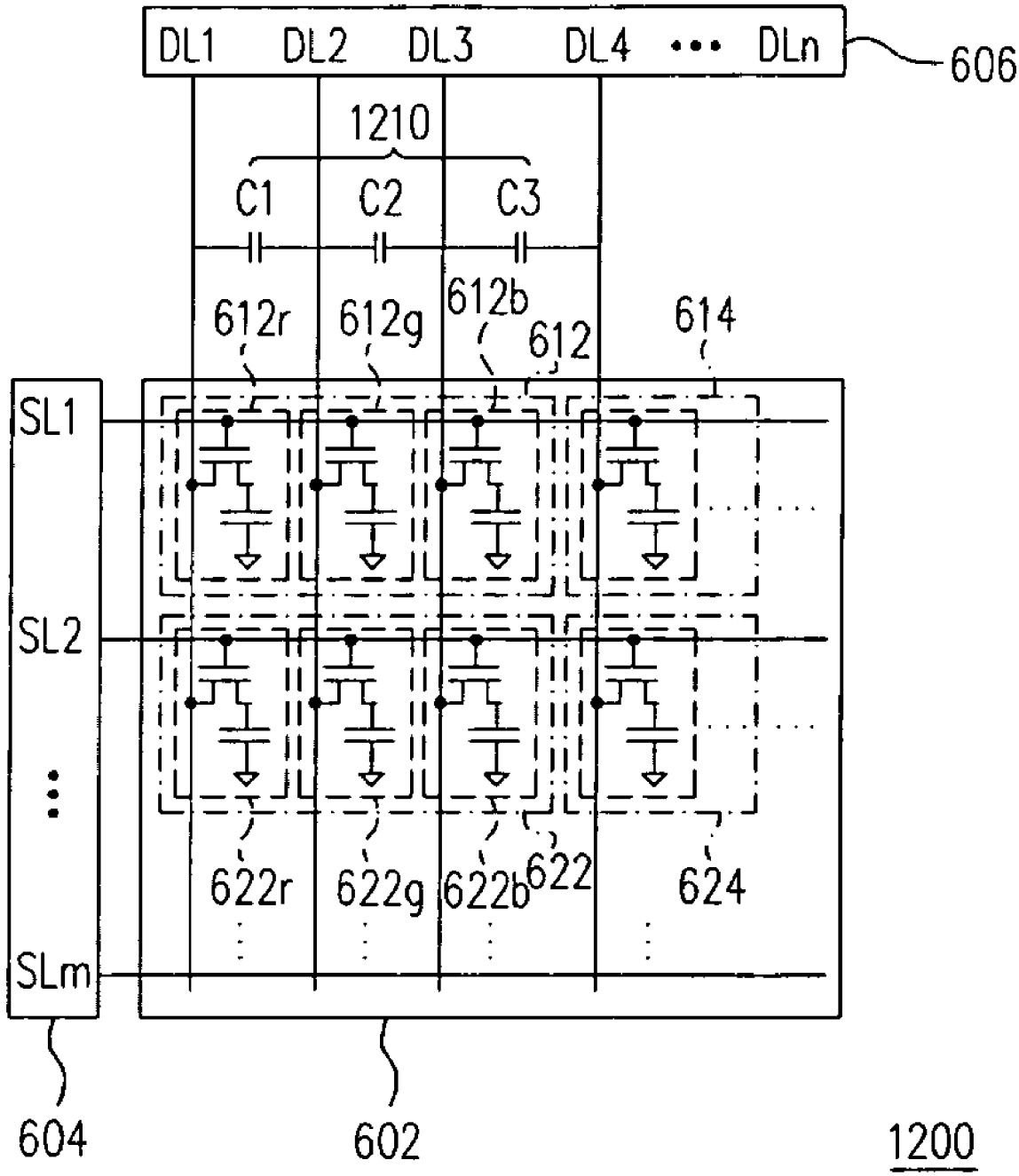
FIG. 12 is a schematic view of a LCD panel system according to another embodiment of the present invention.

According to various embodiments, a charge coupling component can be disposed between each data line for adjust coupling amount of each data lines. FIG. 12 is a schematic view of a LCD panel system according to another embodiment of the present invention. Referring to FIG. 6 and FIG. 12, the LCD panel system 1200 is similar with the LCD panel system 600 shown in FIG. 6 except for the charge coupling components 1210. In the present invention, the charge coupling components 1210 are capacitors with predetermined capacitance according to display panel design, such as size, resolution, and liquid crystal characteristic etc. Preferably, the capacitors include first capacitors C1, second capacitors C2 and third capacitors C3. As shown in FIG. 12, each first capacitor C1 is disposed between the data line (DL1, DL4, . . . DLn-2) connected to the first color sub-pixel 612*r* and the data line (DL2, DL5, . . . DLn-1) connected to the second color sub-pixel 612*g*; each second capacitor C2 is disposed between the data line (DL2, DL5, . . . DLn-1) connected to the second color sub-pixel 612*g* and the data line (DL3, DL6, . . . DLn) connected to the third color sub-pixel 612*b*; and each third capacitor C3 is disposed between the data line (DL3, DL6, . . . DLn-2) connected to the third color sub-pixel 612*b* and the data line (DL4, DL7, . . . DLn-3) connected to the first color sub-pixel 612*r*.

In the present invention, the capacitance of the first capacitors C1 is less than the capacitance of the second capacitors C2 and the capacitance of the third capacitors C3. According to various embodiments, the capacitance of the second capacitors C2 are substantially equal to the capacitance of the third capacitors C3. For example, the capacitance of the first capacitors C1: the capacitance of the second capacitors C2: the capacitance of the third capacitors C3 is about 1:3:3. The source driving method of the present invention can decrease the difference of transmittance by the LC effect, and the charge coupling component can increase the coupling effect of data lines and compensate the difference of transmittance of color sub-pixels by the coupling effect of voltage. Consequently, the displaying image color can be improved.

Figure 13:
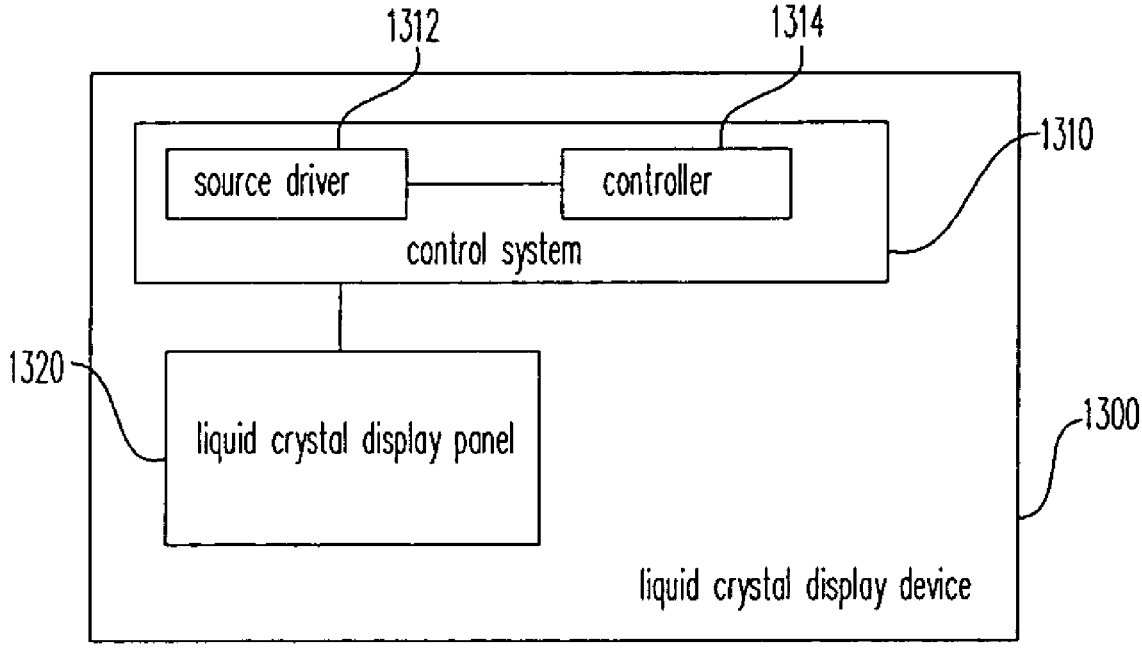
FIG. 13 is a schematic circuit block diagram of a LCD device according to one embodiment of the present invention.

FIG. 13 is a schematic circuit block diagram of a LCD device according to one embodiment of the present invention. The LCD device 1300 may comprise a control system 1310 and a LCD panel 1320 comprising a plurality of pixels that each comprises a plurality of sub-pixels corresponding to different display wavelengths within a pixel (as shown in FIG. 6) or further comprising a plurality of charge coupling components (as shown in FIG. 12). The control system 1310 may comprise a source driver 1312 and a controller 1314 controlling the operations of the source driver 1312, wherein the source driver 1312 has the same functions with those such as source drivers 606 in FIGS. 6 and 12, 700 in FIG. 7, and details are not repeated here.

Figure 14:
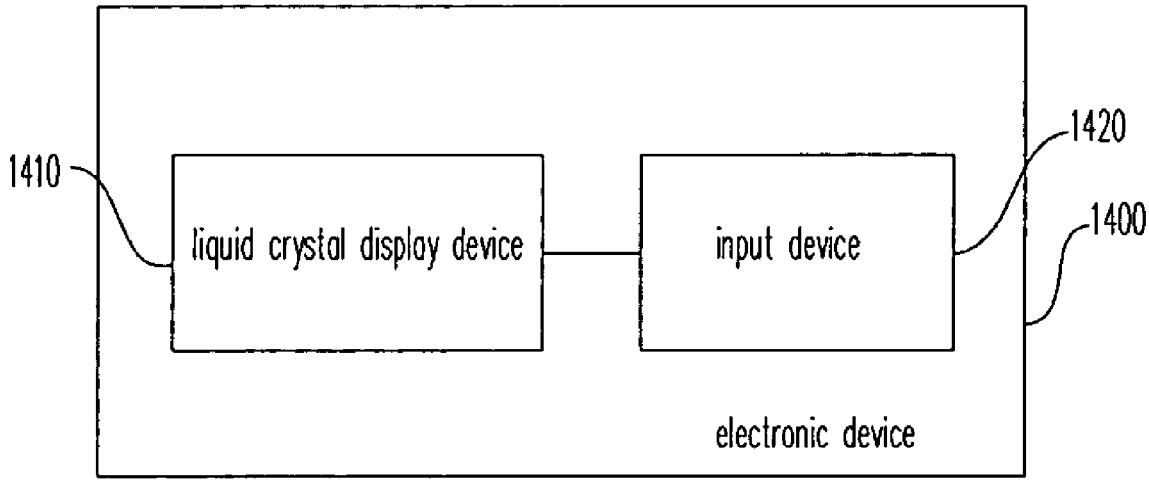
FIG. 14 is a schematic circuit block diagram of an electronic device according to one embodiment of the present invention.

The present invention also provides an electronic device. FIG. 14 is a schematic circuit block diagram of an electronic device according to one embodiment of the present invention. Referring to FIG. 14, the electronic device 1400 comprises a LCD device 1410 such as those mentioned above and an input device 1420 providing image data to the controller in the LCD device 1410 to render an image in accordance with the image data.

In summary, the present invention provides a source driving method and a source driver which drive different color sub-pixels along a driving direction different from the conventional manner. The driving direction is from the sub-pixel with smaller displaying wavelength to that with greater displaying wavelength. Therefore, the coupling effect of voltage produced as driving the sub-pixels can be used to compensate for the difference of brightness caused by the LC effect, and the image color fidelity can be improved. While the illustrated embodiments illustrate an LCD device with pixels comprising three sub-pixels, it is well contemplated that the concept of the present invention is also applicable to less (e.g., two sub-pixels of different wavelengths) or more sub-pixels than three sub-pixels per pixel.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A source driving circuit for a liquid crystal display panel having a plurality of pixels each comprising a plurality of sub-pixels, comprising:

a plurality of data lines each coupled to a sub-pixel;

a source driver controlling the sub-pixels via the data lines; and a plurality of capacitors, each coupling two adjacent data lines, wherein each pixel comprises a first color sub-pixel with a first displaying wavelength, a second color sub-pixel with a second displaying wavelength less than the first displaying wavelength, and a third color sub-pixel with a third displaying wavelength less than the second displaying wavelength, wherein the capacitors comprise a plurality of first capacitors, each first capacitor being disposed between the data line connected to the first color sub-pixel and the data line connected to the second color sub-pixel; a plurality of second capacitors, each second capacitor being disposed between the data line connected to the second color sub-pixel and the data line connected to the third color sub-pixel; and a plurality of third capacitors, each third capacitor being disposed between the dais line connected to the third color sub-pixel and the data line connected to the first color sub-pixel, and wherein the capacitance of the first capacitors is less than the capacitance of the second capacitors and the capacitance of the third capacitors.

2. The source driving circuit according to claim 1, wherein the capacitance of the second capacitors is substantially equal to the capacitance of the third capacitors.

3. A liquid crystal display panel system, comprising:

a liquid crystal display panel comprising a plurality of scan lines, a plurality of data lines and a plurality of pixels, wherein each pixel comprises a plurality of sub-pixels;

a gate driver electrically connected to the scan lines;

a source driver circuit as in claim 1.

4. A liquid crystal display device, comprising:

a liquid crystal display panel system as in claim 3; and a control system comprising a source and a controller.

5. An electronic device, comprising:

a liquid crystal display device as in claim 4; and an input device providing image data to the liquid crystal display device to render an image in accordance with the image data.

6. The source driving circuit according to claim 1, wherein the source driver sequentially activates the sub-pixels within the pixel, in the order from a sub-pixel corresponding to the shortest display wavelength to a sub-pixel corresponding to longest display wavelength.

7. A source driving method for a liquid crystal display panel having a plurality of pixels each comprising a plurality of sub-pixels, comprising:

coupling a data line to each sub-pixel;

coupling a plurality of capacitors, each coupling between two adjacent data lines; and controlling the sub-pixels via the data lines using a source driver, wherein the sub-pixels comprise first color sub-pixels each with a first displaying wavelength, second color sub-pixels each with a second displaying wavelength less than the first display wavelength, and third color sub-pixels with a third displaying wavelength less than the second displaying wavelength, wherein the capacitors comprise a plurality of first capacitors, each first capacitor being disposed between the data line connected to the first color sub-pixel and the data line connected disposed between the data line connected to the second color sub-pixel and the data line connected to the third color sub-pixel; and a plurality of third capacitors, each first capacitor being disposed between the data line connected to the third color sub-pixel and the data line connected to the first color sub-pixel, and wherein the capacitance of the first capacitors is less than the capacitance of the second capacitors and the capacitance of the third capacitors.

8. The source driving method according to claim 7, wherein the step of controlling the sub-pixels via data lines using the source driver comprising: sequentially activating the sub-pixels, in order to from a sub-pixel corresponding to the shortest display wavelength to a sub-pixel corresponding to longest display wavelength.

9. The source driving method according to claim 7, wherein the capacitance of the second capacitors is substantially equal to the capacitance of the third capacitors.

* * * * *